United States Patent [19]

Precht

[11] 3,945,863

[45] Mar. 23, 1976

[54] PROCESS FOR TREATING METAL POWDERS

[75] Inventor: Walter Precht, Towson, Md.

[73] Assignee: Martin Marietta Corporation, Rockville, Md.

[22] Filed: Sept. 20, 1973

[21] Appl. No.: 399,159

[52] U.S. Cl. ..... 148/126; 75/211
[51] Int. Cl.[2] ..... B22F 1/00
[58] Field of Search ..... 148/126; 75/211

[56] References Cited

UNITED STATES PATENTS

| | | | |
|---|---|---|---|
| 3,214,262 | 10/1965 | von Bogdandy et al. | 148/126 |
| 3,325,277 | 6/1967 | Huseby | 148/126 |
| 3,725,142 | 4/1973 | Huseby | 148/126 |
| 3,744,993 | 7/1973 | Matt et al. | 148/126 |
| 3,746,584 | 7/1973 | Takeda et al. | 148/126 |

*Primary Examiner*—Benjamin R. Padgett
*Assistant Examiner*—B. Hunt
*Attorney, Agent, or Firm*—John A. Crowley, Jr.; Charles N. Shane; James B. Eisel

[57] ABSTRACT

A process for pretreating metal powders for the preparation of dispersion hardened metal alloys whereby an iron, cobalt or nickel base metal powder is homogeneously mixed with a chromium powder and with a prealloyed metal carbide powder and granulated to a powder granulate. The granulate is then classified and reduced to remove oxygen present therein.

14 Claims, 3 Drawing Figures

PROCESS FOR TREATING METAL POWDERS

BACKGROUND OF THE INVENTION

Prior practices of producing a strong metal matrix for iron, cobalt or nickel base alloys generally use a casting technique. In such a technique, as typified by U.S. Pat. No. 3,432,294, the composition control is dictated by the solubilities of the components and this does not permit the precipitation of large volume fractions of individual components into the metal matrix by the casting of the alloy.

In order to increase the volume of a component into the metal matrix beyond those determined by equilibrium considerations, powder metallurgy processes have been utilized. However, in utilizing these techniques, the presence of oxygen in the metal powders, particularly in the form of $Cr_2O_3$, and the extremely fine particle size of the dispersed phase have proved problemsome.

Among the prior art metallurgical processes, there is included a process described in U.S. Pat. No. 3,393,067. This patent teaches a process for producing chromium alloy compositions whereby a mixed oxide powder is prepared with carbon and heated to a temperature in the range of 805°–1050°C. whereby any chromium oxide present therein is reduced. The product formed was a fine powder having thoria uniformly dispersed in the alloy matrix. The hydrogen reduction resulted in an oxide content in the final product of less than 0.5 percent, preferably 0.1 percent, exclusive of the oxygen associated with the refractory oxide ($ThO_2$).

U.S. Pat. No. 3,446,679 discloses a dispersion strengthened nickelchromium alloy. This alloy is first formed by preparing a nickel oxide, chromium oxide and thorium oxide powder. This powder was blended with carbon and heated with hydrogen at 400°C. to reduce the nickel oxide, and then at 925°C. in a $H_2$ — $CH_4$ mixture to reduce the $Cr_2O_3$. The product was subsequently treated by known techniques in order to produce a useful alloy foil product.

U.S. Pat. No. 3,595,710 describes a dispersion hardened nickel or cobalt base alloy. A Ni — Cr — Fe — $ThO_2$ powder was first prepared. The powder was mixed with water and briquetted. The briquettes were hydrogen reduced at temperatures up to 400°C. and finally up to a maximum of 750°C. The briquettes were crushed and pulverized and subsequently subjected to well-known treating operations to produce a dispersion hardened metal product.

The above processes are generally satisfactory in producing dispersion hardened alloys but they do not achieve the strengthening of the metal matrix obtained by the process of this invention which process enables a rather large and controlled amount of carbide particles to be uniformly dispersed in the metal matrix and, at the same time, eliminates the occurrence of the deleteriously high oxygen content which normally would be retained in a product utilizing metal powders as starting materials. Further, by the practice of the process of this invention the mixed powder upon being subjected to high temperature reduction, will not bond together into the form of a sintered hard cake but instead remains as a powder that may be compacted, densified and shaped by normal powder metallurgy methods to yield high strength alloys.

It is an object of this invention to provide a process for pretreating metal powders for the preparation of dispersion hardened alloys. Other objects will be apparent to those skilled-in-the-art from an inspection of the description hereinafter set forth.

SUMMARY OF THE INVENTION

In accordance with certain of its aspects, the novel process of this invention for pretreating metal powders for the preparation of dispersion hardened alloys may comprise homogeneously blending together a mixed powder containing (i) a metal powder having a base metal selected from the group consisting of iron, cobalt and nickel, (ii) a chromium metal powder and (iii) a prealloyed metal carbide powder; granulating the mixed powder to produce a powdered granulate; classifying the powdered granulate to separate out the powdered granulate having a mesh size of about −40 + 100; reducing the oxygen present in the separated out powdered granulate at a temperature of between about 1150°–1300°C. to form an unsintered mass of granulate suitable for the preparation of dispersion hardened alloys.

DESCRIPTION OF THE INVENTION

It is contemplated by this invention that a mixed powder may be prepared. The mixed powder may contain a metal powder having a base metal which may typically include iron, cobalt or nickel, preferably cobalt. These metals are base metals of the so-called "super alloy" type which have been developed for maximum possible service life at extremely high temperatures under very high stress and strain conditions. The metal powders may be commercially pure and thus by nature may carry a number of impurities, including oxygen. Alternatively, the metal powders may be in the form of the metal oxides.

The aforementioned mixed powder may also contain chromium metal powder. The chromium component may add strength and oxidation resistances to the resulting alloy which may be produced by further treating the product of this invention by well-known powder metallurgical procedures.

A third component of the mixed powder may be a prealloyed metal carbide powder. Typically, the metal of the metal carbide powder may include titanium, zirconium, hafnium, vanadium, niobium and tantalum, or mixtures thereof, preferably titanium and vanadium.

It is to be understood that in addition to the aforementioned powders other types of powders may be incorporated into the mixed powder. For example, with respect to the iron base metal powders, other metal powder components, including molybdenum, nickel, chromium, sulfur, phosphorous, silicon, and manganese may be added in small amounts to produce a suitable final alloy. With regards to the nickel base metal powders, other metal powder components, such as cobalt, titanium, aluminum, iron, chromium, tungsten, niobium, zirconium, carbon and silicon may be utilized therewith in order to produce suitable final alloy products. With respect to the cobalt base metals, nickel, chromium, boron, silicon, tungsten, vanadium, manganese, iron, niobium and zirconium may be used to produce suitable alloy products.

In the practice of this invention, the mixed powder may be prepared by blending and mixing the metal base powder, the chromium metal powder and the prealloyed metal carbide powders together with other types of metal powders previously mentioned. It is important that such mixing homogeneously blends the mixed powders together so that all the metal powders become uniformly blended. To achieve this homogeneous blending, the mixed powders may be finely divided and may typically have the size of between −200 to −400 mesh, preferably −325 mesh. The carbide powder additions should typically be <0.5μ, preferably 0.1μ. The particular time that may be needed to homogeneously blend the powders is not critical; however, the blending operation should be of a sufficient time to enable both the carbide powders and the other metal powders to become uniformly blended. The temperature at which the blending operation may be conducted may vary but, preferably, it may be at room temperature.

The relative proportions of each one of these component powders that may be used may be generally dependent upon the characteristic of the resulting alloy that is sought to be produced. For a resulting cobalt base alloy having chromium and nickel components, the amount of powdered metal carbide that may be used may be between 3 to 10 percent, preferably 3 percent by weight of the total mixed powder. The amount of chromium powder may be between 12 – 26 percent by weight, preferably 18 percent of the total mixed metal powder, while the amount of nickel may be between 18 to 26 percent, preferably 20 percent by weight of the total mixed metal powder. It has been found that such powders may have a relatively high starting oxygen content, typically between 2,000 to 6,000 ppm, say 4,000 ppm.

The blended powders may then be granulated to produce a powdered granulate. The granulating operation may take place with or without the use of a binder; however, preferably a binder may be found useful. The binder may be selected from any well-known binding materials used for metal powders and may include water, polyvinyl alcohol or waxes. The preferential binder that may be used is polyvinyl alcohol.

The particular amount of binder that may be utilized may be that amount which is able to produce a granulate that may have a particle size hereinafter described. When utilizing the preferred binder, namely polyvinyl alcohol, typically ½ to 3 percent by weight of the binder may be used, preferably 1 percent by weight of the binder may be added to the total powder blend of the aforementioned cobalt base system.

Alternately, the granulating step may be accomplished without the use of a binder. Such an operation may require the mixed powder to be lightly compacted so as to cause the individual particles of the powder to agglomerate and cohere together to produce a granulate. In order to lightly compact the mixed powder, a pressure of typically 500 to 1,500 p.s.i., preferably 1,000 p.s.i., may be applied against the powder.

The powdered granulate may be subsequently classified to separate out the powdered granulate having a mesh size of about −40 + 100, preferably about −40 + 80. This classifying operation may be accomplished by the use of a pair of screens, one of which has a mesh size equal to the lower value of the above mesh range while the other carries the size of the upper range value. Any size of granulate which may fall between these two screens may be further treated in accordance with this invention. Since a particle size of −100 mesh may have a tendency to stick together or agglomerate during further treatment operations, it may be concluded that the use of such small size particles might yield a sintered cake after any hydrogen reduction at temperatures hereinafter set forth. It may be feasible to use larger size particles than that previously described; however, such use may incur handling problems in subsequent powder metallurgical operations.

The classified granulate may then be subjected to a reducing operation such that the oxygen present therein may be reduced to low levels of concentration. For the cobalt-nickel-chromium alloy of the type previously described, the oxygen content of the original powders may be reduced down to 200 to 400 ppm, preferably 200 ppm. The reduction operation may take place in the presence of a reducing gas, typically hydrogen or carbon monoxide, preferably hydrogen. The temperature under which the granulate may be reduced may be typically between 1150° to 1300°C., or preferably at 1200°C. The length of time of the reducing operation and the amount of the reducing gas that may be utilized may be dependent upon the particular make-up of starting mixed powder that is being treated. For a cobalt base powder having nickel and chromium components, typically between 2 to 8 hours, preferably 3 hours for one-fourth pound of mixed powder, may be needed to satisfactorily reduce the oxygen level of the granulate to that desired, while the amount of reducing gas may be between typically 20 to 120 cubic feet/hour, preferably 20 cubic feet/hour for the same amount of material for a 2½ inch diameter furnace muffle.

The reduced granulate may then be cooled in the presence of the reducing gas or, alternately, the granulate may be placed in a cooling chamber until the granulate may reach a temperature at which it can be easily handled. Preferably, such a temperature may be room temperature. The cooled granulate may thereafter be subjected to well-known standard powder metallurgical processes, such as compacting, sintering, densifying and shaping in order to produce a dispersion hardened alloy.

It is a feature of the preferred aspect of the process of this invention to produce a dispersion hardened alloy that has a strong metal matrix and is more ductile at high temperature. This process enables a rather large and controlled amount of carbide particles to be uniformly dispersed in the metal matrix and, at the same time, eliminates the occurrence of the deleteriously high oxygen content which normally would be retained in an alloy product that utilized metal powders as starting materials.

It is a particular feature of the process of this invention that the alloys may be more easily produced because the granulate, upon being subjected to high temperature reduction, will not bond together into the form of a sintered hard cake. Instead, the reduced granulate of this invention retains a free flowing powder consistency that may be easily compacted, densified and shaped by normal powder metallurgy methods to yield high strength alloys.

The practice of the process of this invention may be illustrated by the following detailed description of the preferred embodiment. As elsewhere stated in this description, all parts listed are set forth as parts by weight.

DESCRIPTION OF THE PREFERRED EMBODIMENT

In the practice of this invention 21 percent by weight chromium oxide powder, 26 percent nickel powder, 5 percent of a 50 percent titanium carbide (TiC)-vanadium carbide (VC) mixed powder, and 48 percent of cobalt powder may be added to a vessel and homogeneously mixed. The blended powder may be placed in a dish and sufficient water, containing 1 percent polyvinyl alcohol (PVA), may be added to make a paste. The paste may then be hand blended and oven dried at 60°C. for 3 hours or vacuum dried. The drying step removes the moisture and the original individual particles are now agglomerated and thus cohere together to produce a granulate.

The powder blend may be then screened to separate out a powdered granulate which is between −40 and +80 mesh. About one-fourth pound of this separated granulate may be placed in a molybdenum boat which may be positioned in a furnace and heated to 1200°C. About 20 cubic feet/hour of hydrogen may then be passed through a 2½ inch diameter furnace muffle in contact with the granulate in the boat for about 3 hours. The granulate may be cooled by discontinuing the heat applied to the furnace and the flow of hydrogen may be continued at the forementioned rate for 1 hour until the temperature of the granulate reaches room temperature. The granulate may then be treated by well-known powder metallurgical processes to produce a dispersion hardened cobalt base alloy.

Figure 1:
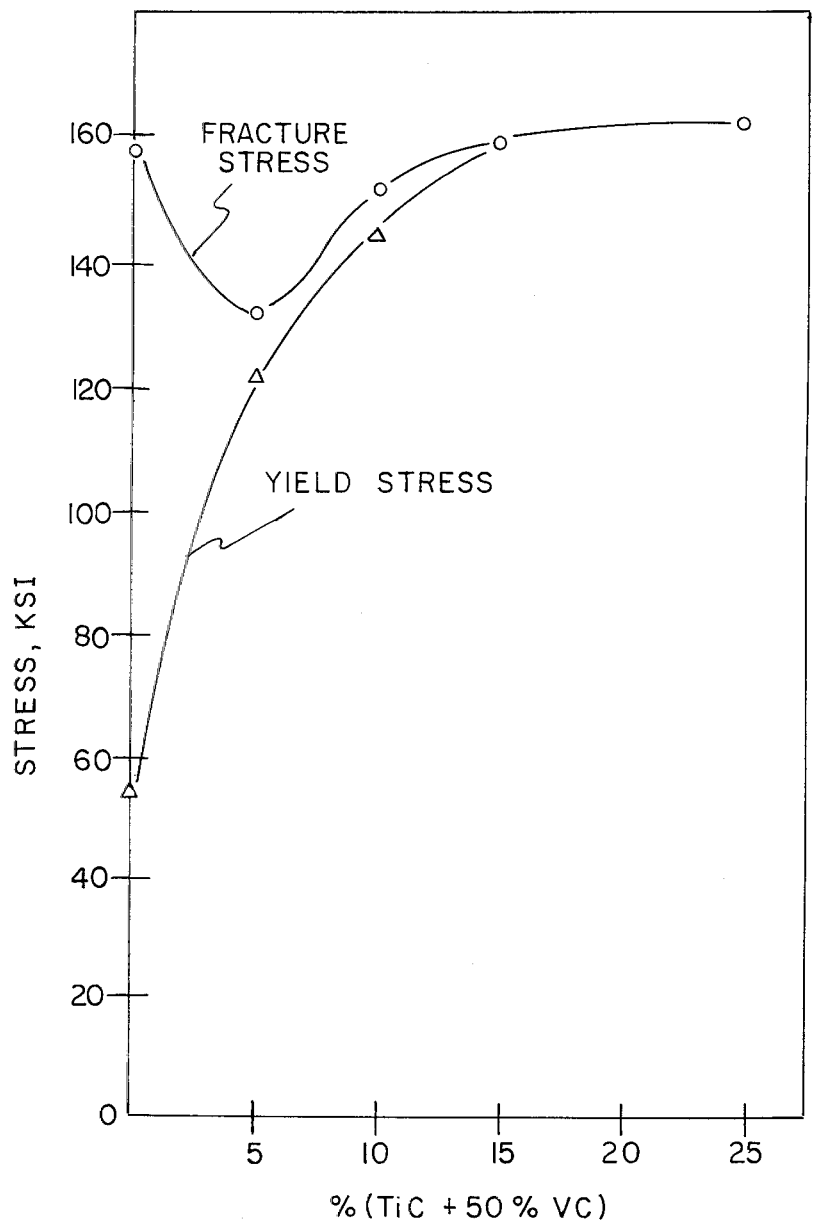
FIG. 1 is a graph of the stress rupture life of a preferred alloy of this invention.

The influence of carbide additions on the room temperature tensile properties of a Co — 21 percent Cr — 26 percent Ni alloy may be seen in FIG. 1 of the drawings. Tensile samples of such a composite containing between 5 and 25 percent metal carbide also were prepared from the mixed powders treated in accordance with the process of this invention and their room temperature yield and tensile strengths were plotted as a function of the carbide content. The carbide additions were found to produce a considerable increase in the yield strength. All alloys containing above 15 percent TiC/VC were found to be brittle at room temperature.

Pellets of Co — 21 percent Cr — 26 percent Ni containing 10 percent TiC/VC (Alloy A) were prepared by first producing a granulate in accordance with this invention. The reduced metal powders were hot pressed and tested at ambient and elevated temperatures. This data is set forth in Table I below:

TABLE I

| Test Temp. °C. | Yield Stress Ksi | Ultimate Tensile Strength (UTS) ksi | % Strain at Fracture |
|---|---|---|---|
| 20 | 143.4 | 150.7 | 1.0 |
| 800 | 99.6 | 102 | |
| 1100 | 46.2 | 50.6 | 1.0 |

where the stress at fracture relates to load per square inch of area required to rupture the material.

Figure 2:
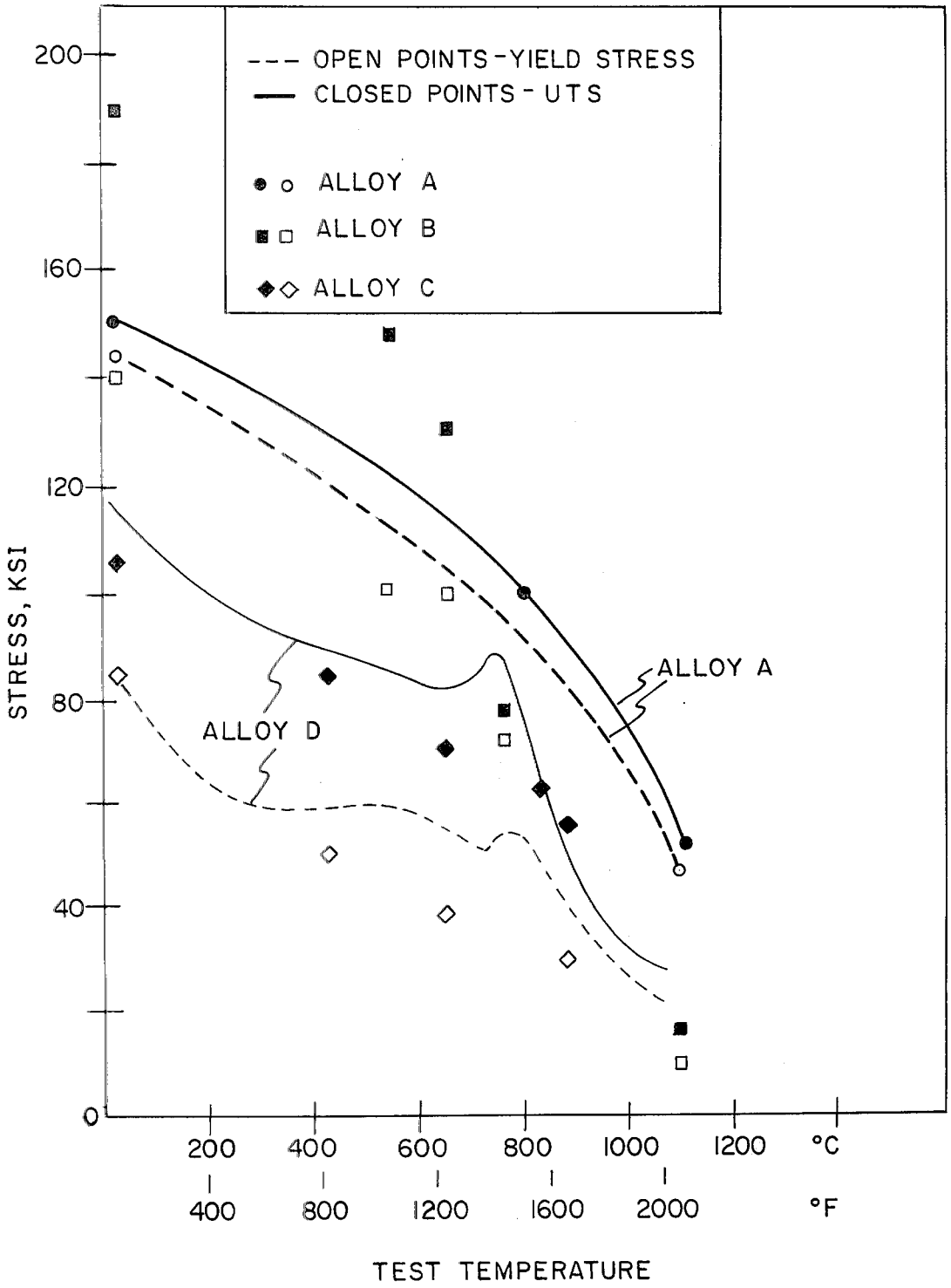
FIGS. 2 and 3 are graphs of the tensile and yield stress of alloys of this invention in comparison with two other known alloys.

The values from Table I are found graphically illustrated in FIG. 2 along with yield and UTS values for other commercial cobalt base alloys, such as Alloys B, C and D. The component make-up of Alloys B, C and D are set forth in Table II below:

TABLE II

| | |
|---|---|
| Alloy B | Co - 20 Ni - 20 Cr - 10 W - 2 $ThO_2$ |
| Alloy C | 0.25 C - 0.6 Mn - 0.6 Si - 0.27 Cr - 3 Ni - 5 Mo - 1.0 Fe - 0.007 B - Co (balance) |
| Alloy D | 0.60 C - 23.5 Cr - 7 W - 3.5 Ta - 2 Ti - 0.5 Zr - 10 Ni - Co (balance) |

where the above numbers are percent by weight. It will be noted that the UTS and yield strength values of Alloy A are greater than the other commercial alloys with the exception of Alloy B at low temperatures.

At low temperatures, Alloy B is considerably stronger than either Alloys A, C or D, but the strength of Alloy B decreases rapidly about 700°C. and is considerably less than that of Alloy A at elevated temperatures.

Pellets of the compositions listed in Table III below were prepared by first producing a granulate in accordance with this invention. Note that Alloys F and G contain a low amount of metal carbide powder.

TABLE III

| | |
|---|---|
| Alloy E | 63 Co - 17 Cr - 20 Ni |
| Alloy F | 58 Co - 17 Cr - 20 Ni - 5 W - 3 TiC |
| Alloy G | 63 Co - 17 Cr - 20 Ni - 3 TiC |

where the above numbers are percent by weight.

The granulates of Alloys E, F, and G were then hot pressed and tested at ambient and elevated temperatures. This data is set forth in Table IV below:

TABLE IV

| Test Temp. °C. | ALLOY E Ultimate Tensile Strength (UTS) ksi | % Strain at Fracture |
|---|---|---|
| 20 | 135 | |
| 800 | 30 | 5.5 |
| 1050 | 10 | 4.2 |
| **Test Temp. °C.** | **ALLOY F Ultimate Tensile Strength (UTS) ksi** | **% Strain of Fracture** |
| 20 | 165 | |
| 800 | 65 | 13.0 |
| 1050 | 27 | 10.0 |
| **Test Temp. °C.** | **ALLOY G Ultimate Tensile Strength (UTS) ksi** | **% Strain at Fracture** |
| 20 | 157 | |
| 800 | 57 | 19.0 |
| 1050 | 25 | 4.5 |

Figure 3:
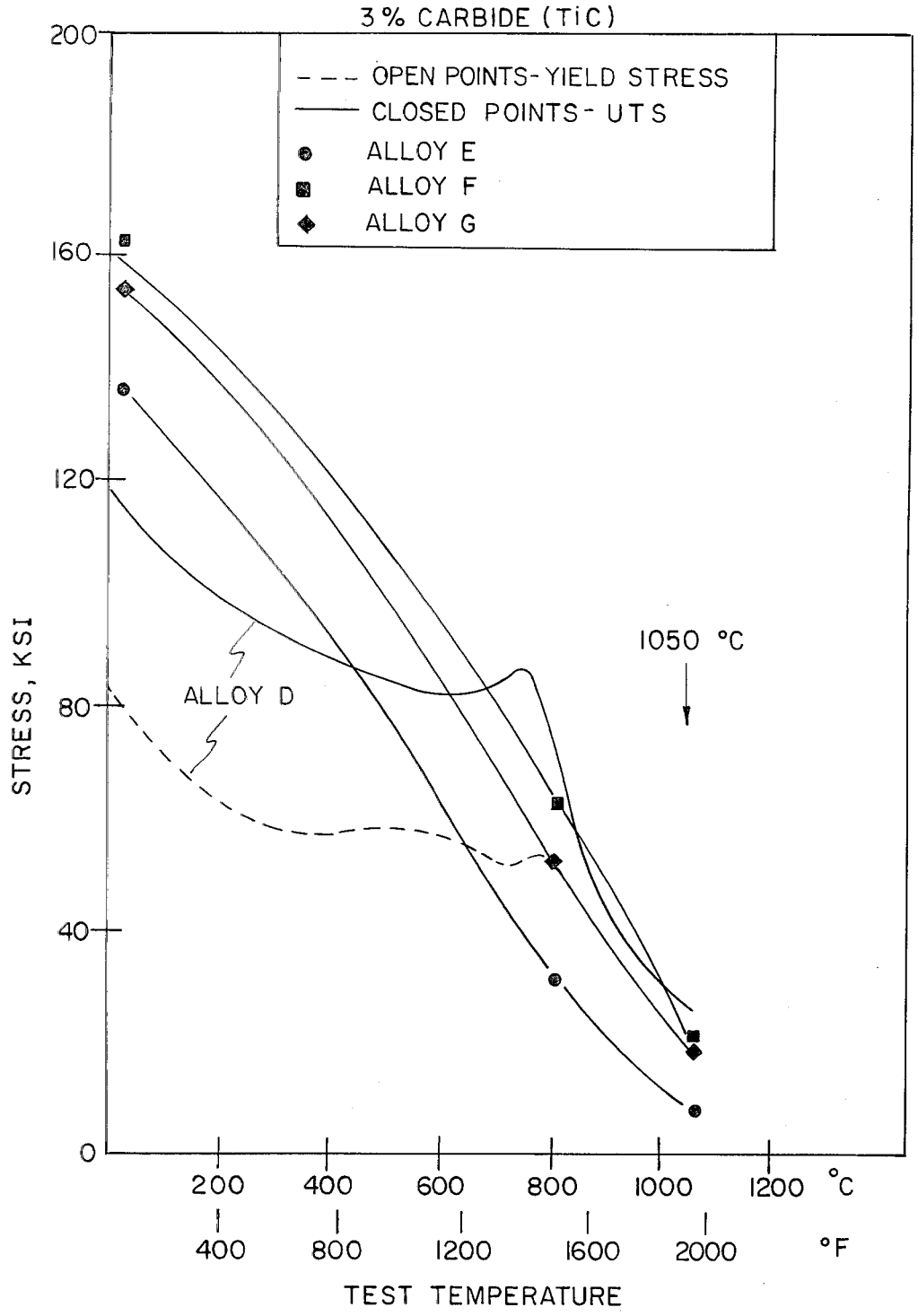

The values from Tables III and IV are graphically represented in FIG. 3 along with the yield and ultimate tensile strength values for Alloy D. It will be noted that at the low carbide range, the alloys of the invention, namely Alloys F and G, compare very favorably with Alloy D at high temperatures and are considerably stronger than Alloys D and E and low temperatures. This figure also shows the improved ultimate tensile strength with carbide additives (Alloys F and G) over that of no carbide addition (Alloy E).

Although this invention has been described with reference to certain aspects and embodiments thereof, it will be apparent to those skilled-in-the-art that changes and modifications may be made thereto which fall within the scope of the claims.

I claim:

1. A process for the pretreating of metal powders for the preparation of dispersion hardened alloys, said process comprising:

a. homogeneously blending together a mixed powder containing (i) a metal powder having a base metal selected from the group consisting of iron, cobalt and nickel, (ii) a chromium metal powder, (iii) a prealloyed metal carbide powder;

b. granulating the mixed powder to produce a powdered granulate;

c. classifying the powdered granulate to separate out the powdered granulate having a mesh size of about −40 + 100; and d. reducing the oxygen present in the separated out powdered granulate at a temperature of between about 1150°–1300°C. to form an unsintered granulate mass suitable for the preparation of dispersion hardened alloys.

2. The method of claim 1, wherein the metal of said metal carbide powder is selected from the group consisting of titanium, zirconium, hafnium, niobium, vanadium, and tantalum, and mixtures thereof.

3. The method of claim 1, wherein the size of the starting mixed powder is between about −200 to −325 mesh.

4. The method of claim 1, wherein the metal carbide powder is present in the amount of between 3–10% by weight of the total weight of the mixed powder.

5. The method of claim 1, wherein the powders are granulated in the presence of a binder.

6. The method of claim 5, wherein the binder is selected from the group consisting of water, polyvinyl alcohol and wax.

7. The method of claim 1, wherein the powders are granulated by light compacting to produce the granulate.

8. The method of claim 1, wherein the powdered granulate is classified to separate out the granulate having a −40 + 80 mesh size.

9. The method of claim 8, wherein said classifying is made by screening the granulate.

10. The method of claim 1, wherein the powdered granulate is reduced by hydrogen or carbon monoxide.

11. The method of claim 1, wherein the oxygen of the mixed powder is reduced to between about 200 ppm to about 400 ppm.

12. The method of claim 9, wherein the reduced granulate is cooled.

13. The method of claim 12, wherein the reduced granulate is cooled in the presence of hydrogen.

14. A process for the pretreating of metal powders for the preparation of dispersion hardened alloys, said process comprising:

a. homogeneously blending together a mixed powder containing (i) a cobalt base nickel metal powder, (ii) a chromium metal powder and (iii) a titanium carbide and vanadium carbide powder mixture, said carbide powder mixture present in the amount of about 3–10 percent of the total weight of the mixed powder;

b. granulating the mixed powder in the presence of a polyvinyl chloride binder;

c. classifying the powdered granulate to separate out the powdered granulate having a mesh size of about −40 + 80;

d. reducing the separated out powdered granulate with hydrogen at a temperature of between 1150°–1300°C. so as to reduce the oxygen present in the powdered granulate to below 400 ppm without sintering the powdered granulate mass; and e. cooling the granulate to about room temperature in the presence of hydrogen to form a suitable granulate for the preparation of dispersion hardened alloys.

* * * * *